US009000339B2

(12) United States Patent
Burke

(10) Patent No.: US 9,000,339 B2
(45) Date of Patent: Apr. 7, 2015

(54) MICROWAVE HEATING APPARATUS WITH FOOD SUPPORTING CRADLE

(75) Inventor: Bradley J. Burke, Glendale Heights, IL (US)

(73) Assignee: Graphic Packaging International, Inc., Atlanta, GA (US)

( * ) Notice: Subject to any disclaimer, the term of this patent is extended or adjusted under 35 U.S.C. 154(b) by 1049 days.

(21) Appl. No.: 13/070,573

(22) Filed: Mar. 24, 2011

(65) Prior Publication Data

US 2011/0233201 A1 Sep. 29, 2011

Related U.S. Application Data

(60) Provisional application No. 61/318,438, filed on Mar. 29, 2010, provisional application No. 61/400,395, filed on Jul. 26, 2010.

(51) Int. Cl.

| | |
|---|---|
| ***H05B 6/80*** | (2006.01) |
| ***B65D 5/54*** | (2006.01) |
| ***B65D 43/00*** | (2006.01) |
| ***H05B 6/64*** | (2006.01) |
| ***B65D 81/34*** | (2006.01) |

(52) U.S. Cl.

CPC ..... *H05B 6/6408* (2013.01); *H05B 6/6494* (2013.01); *B65D 81/3453* (2013.01); *B65D 2205/02* (2013.01); *B65D 2581/346* (2013.01); *B65D 2581/3472* (2013.01); *B65D 2581/3474* (2013.01); *B65D 2581/3477* (2013.01); *B65D 2581/3479* (2013.01); *B65D 2581/3497* (2013.01); *B65D 2581/3498* (2013.01)

(58) Field of Classification Search

CPC ..... H05B 6/6408; H05B 6/6494; B65D 81/3453; B65D 2205/02; B65D 2581/346; B65D 2581/3472; B65D 2581/3477; B65D 2581/3479; B65D 2581/3497; B65D 2581/3498; B65D 2581/3474

USPC ..... 219/725–735, 759, 762; 99/DIG. 14; 426/107, 109, 113, 234, 241, 243; 229/101.1, 125.02, 242, 128, 903, 938

See application file for complete search history.

(56) References Cited

U.S. PATENT DOCUMENTS

| | | | |
|---|---|---|---|
| 3,865,301 | A | 2/1975 | Pothier et al. |
| 4,192,540 | A | 3/1980 | Oliff |

(Continued)

FOREIGN PATENT DOCUMENTS

| | | | |
|---|---|---|---|
| EP | 0 451 530 | A | 10/1991 |
| EP | 2 150 091 | A1 | 2/2010 |

(Continued)

OTHER PUBLICATIONS

International Search Report—PCT/US2007/082477.

(Continued)

*Primary Examiner* — Quang Van

(74) *Attorney, Agent, or Firm* — Womble Carlyle Sandridge & Rice, LLP

(57) ABSTRACT

A microwave heating construct includes a first side wall and a second side wall opposite one another and a food-supporting panel extending between the first side wall and the second side wall. The first side wall includes a movable portion for being positioned over the food-supporting panel. The food-supporting panel and/or the movable portion of the first side wall may include microwave energy interactive material.

16 Claims, 4 Drawing Sheets

(56) References Cited

U.S. PATENT DOCUMENTS

| | | | | |
|---|---|---|---|---|
| 4,210,124 | A | | 7/1980 | Husslein et al. |
| 4,279,374 | A | | 7/1981 | Webinger |
| 4,283,427 | A | | 8/1981 | Winters et al. |
| 4,505,391 | A | | 3/1985 | Kuchenbecker |
| 4,567,341 | A | | 1/1986 | Brown |
| 4,592,914 | A | | 6/1986 | Kuchenbecker |
| 4,705,929 | A | | 11/1987 | Atkinson |
| 4,775,771 | A | | 10/1988 | Pawlowski |
| 4,794,005 | A | | 12/1988 | Swiontek |
| 4,801,774 | A | | 1/1989 | Hart |
| 4,865,921 | A | | 9/1989 | Hollenberg |
| 4,877,932 | A | | 10/1989 | Bernstein et al. |
| 4,890,439 | A | | 1/1990 | Smart |
| 4,936,935 | A | | 6/1990 | Beckett |
| 4,943,456 | A | | 7/1990 | Pollart et al. |
| 4,960,598 | A | | 10/1990 | Swiontek |
| 4,963,240 | A | | 10/1990 | Fukasawa et al. |
| 4,963,424 | A | | 10/1990 | Beckett |
| 5,002,826 | A | | 3/1991 | Pollart et al. |
| 5,009,320 | A | | 4/1991 | Kramer |
| 5,049,710 | A | * | 9/1991 | Prosise et al. ..... 219/730 |
| 5,093,364 | A | | 3/1992 | Richards |
| 5,117,078 | A | | 5/1992 | Beckett |
| 5,118,747 | A | | 6/1992 | Pollart et al. |
| 5,153,402 | A | | 10/1992 | Quick et al. |
| 5,213,902 | A | | 5/1993 | Beckett |
| 5,221,419 | A | | 6/1993 | Beckett |
| 5,247,149 | A | | 9/1993 | Peleg |
| 5,260,537 | A | | 11/1993 | Beckett |
| 5,266,386 | A | | 11/1993 | Beckett |
| RE34,683 | E | | 8/1994 | Maynard |
| 5,340,436 | A | | 8/1994 | Beckett |
| 5,354,973 | A | | 10/1994 | Beckett |
| 5,357,086 | A | | 10/1994 | Turpin et al. |
| 5,410,135 | A | | 4/1995 | Pollart |
| 5,412,187 | A | | 5/1995 | Walters et al. |
| 5,424,517 | A | | 6/1995 | Habeger |
| 5,519,195 | A | | 5/1996 | Keefer |
| 5,530,231 | A | | 6/1996 | Walters et al. |
| 5,544,806 | A | | 8/1996 | Anderson et al. |
| 5,628,921 | A | | 5/1997 | Beckett |
| 5,672,407 | A | | 9/1997 | Beckett |
| 5,688,427 | A | | 11/1997 | Gallo, Jr. |
| 5,726,426 | A | | 3/1998 | Davis et al. |
| 5,759,418 | A | | 6/1998 | Frater et al. |
| 5,759,422 | A | | 6/1998 | Schmelzer |
| 5,800,724 | A | | 9/1998 | Habeger |
| 5,948,308 | A | | 9/1999 | Wischusen |
| 6,114,679 | A | | 9/2000 | Lai |
| 6,150,646 | A | | 11/2000 | Lai et al. |
| 6,204,492 | B1 | | 3/2001 | Zeng et al. |
| 6,251,451 | B1 | | 6/2001 | Zeng |
| 6,359,272 | B1 | | 3/2002 | Sadek et al. |
| 6,414,290 | B1 | | 7/2002 | Cole |
| 6,433,322 | B2 | | 8/2002 | Zeng et al. |
| 6,455,827 | B2 | | 9/2002 | Zeng |
| 6,552,315 | B2 | | 4/2003 | Zeng et al. |
| 6,677,563 | B2 | | 1/2004 | Lai |
| 6,717,121 | B2 | | 4/2004 | Zeng |
| 6,765,182 | B2 | | 7/2004 | Cole |
| 6,960,748 | B2 | | 11/2005 | Baker |
| 7,019,271 | B2 | | 3/2006 | Wnek et al. |
| 7,351,942 | B2 | | 4/2008 | Wnek et al. |
| 7,851,731 | B2 | | 12/2010 | Ly |
| 2004/0101605 | A1 | * | 5/2004 | Sigel ..... 426/394 |
| 2005/0230383 | A1 | | 10/2005 | Romeo et al. |
| 2006/0049190 | A1 | | 3/2006 | Middleton |
| 2007/0056962 | A1 | | 3/2007 | Hopkins et al. |
| 2007/0087090 | A1 | | 4/2007 | Russell |
| 2007/0131743 | A1 | * | 6/2007 | Fitzwater ..... 229/101.1 |
| 2008/0035634 | A1 | | 2/2008 | Zeng et al. |
| 2008/0078759 | A1 | | 4/2008 | Wnek et al. |
| 2008/0308614 | A1 | | 12/2008 | Fitzwater |
| 2009/0218338 | A1 | | 9/2009 | Fitzwater |
| 2009/0230126 | A1 | | 9/2009 | Fitzwater |
| 2009/0277899 | A1 | | 11/2009 | Cole |
| 2010/0065556 | A1 | | 3/2010 | Cole |
| 2010/0213192 | A1 | | 8/2010 | Middleton et al. |

FOREIGN PATENT DOCUMENTS

| | | | | |
|---|---|---|---|---|
| FR | 745 013 | A | | 5/1933 |
| FR | 961 269 | A | | 5/1950 |
| GB | 925 971 | A | | 5/1963 |
| GB | 2 127 677 | A | | 4/1984 |
| GB | 2 150 534 | A | | 7/1985 |
| GB | 2 368 507 | A | | 5/2001 |
| GB | 2365000 | A | * | 2/2002 |
| JP | 63-16600 | | | 1/1988 |
| JP | 09-020374 | A | | 1/1997 |
| JP | 2004-257663 | | | 9/2004 |
| JP | 2009-537416 | | | 10/2009 |
| WO | WO 93/19566 | A1 | | 9/1993 |
| WO | WO 2007/127371 | A2 | | 11/2007 |
| WO | WO 2007/136839 | A2 | | 11/2007 |
| WO | WO 2008/052096 | A1 | | 5/2008 |
| WO | WO 2008/115272 | A2 | | 9/2008 |
| WO | WO 2009/023286 | A1 | | 2/2009 |
| WO | WO 2010/033561 | A2 | | 3/2010 |

OTHER PUBLICATIONS

Written Opinion—PCT/US2007/082477.
Notification of Reason for Refusal for JP 2013-502657 dated Nov. 7, 2013, and English translation.
Supplementary European Search Report for EP 11 76 6396 dated Mar. 20, 2014.
International Search Report—PCT/US2011/029705.
Written Opinion—PCT/US2011/029705.

* cited by examiner

MICROWAVE HEATING APPARATUS WITH FOOD SUPPORTING CRADLE

CROSS-REFERENCE TO RELATED APPLICATIONS

This application claims the benefit of U.S. Provisional Application No. 61/318,438, filed Mar. 29, 2010, and U.S. Provisional Application No. 61/400,395, filed Jul. 26, 2010, both of which are incorporated by reference herein in their entirety.

TECHNICAL FIELD

This disclosure relates to various blanks, constructs, and methods for heating, browning, and/or crisping a food item, and particularly relates to various blanks, constructs, and methods for heating, browning, and/or crisping a food item in a microwave oven.

BACKGROUND

Microwave ovens provide a convenient means for heating a variety of food items. However, microwave ovens tend to cook such items unevenly and are unable to achieve a browned, crisp surface, particularly where the food item has a rounded or irregular shape. Thus, there is a continuing need for a microwavable package that provides the desired degree of heating, browning, and crisping for various food items.

SUMMARY

This disclosure is directed to a construct or apparatus for heating, browning, and/or crisping a food item in a microwave oven. In one aspect, the construct may include a generally U-shaped sling or cradle for receiving a somewhat curved food item. The sling or cradle may include microwave energy interactive material to alter the effect of microwave energy on the food item. If desired, the construct may also include one or more features that allow a portion of the construct to be transformed into a cover or lid for the food item. The cover or lid may also include microwave energy interactive material.

The construct may generally be formed from a disposable material, for example, paperboard. The construct may be used to prepare a variety of food items, for example, corn dogs, stuffed breadsticks, chicken strips, soft pretzels, egg rolls, burritos, taquitos, or any other food item.

Additional aspects, features, and advantages of the present invention will become apparent from the following description and accompanying figures.

BRIEF DESCRIPTION OF THE DRAWINGS

The description refers to the accompanying schematic drawings in which like reference characters refer to like parts throughout the several views, and in which.

DESCRIPTION

Figure 1A:
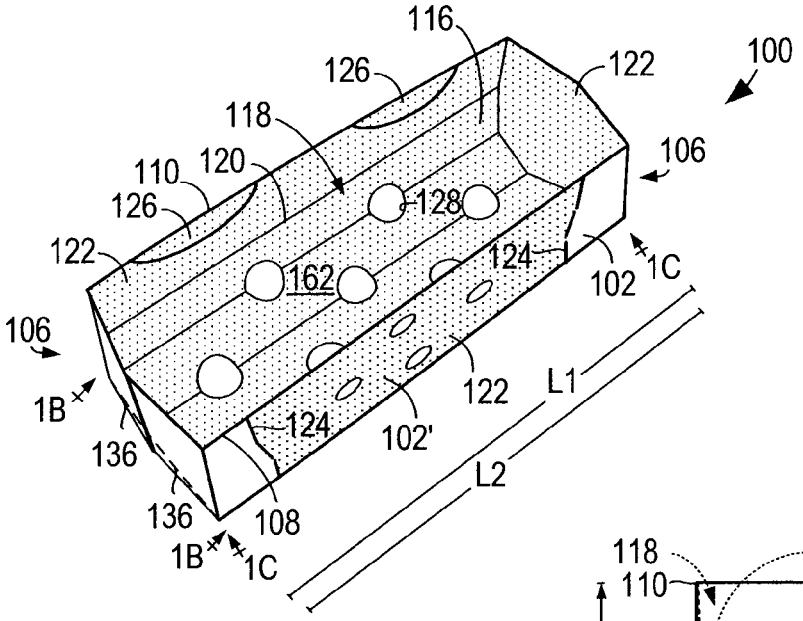
FIG. 1A is a schematic perspective view of an exemplary microwave heating construct, including a movable panel for overlying the interior space.
Figure 1B:
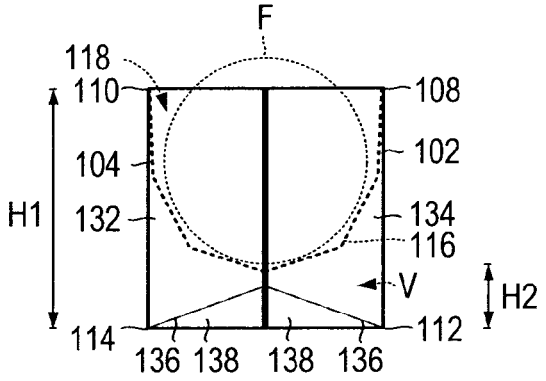
FIG. 1B is a schematic end elevation view of the microwave heating construct of FIG. 1A, containing a food item; taken along a line 1B-1B.

FIGS. 1A-1D schematically illustrate an exemplary construct 100 (e.g., package or carton) for heating, browning, and/or crisping a food item in a microwave oven. The microwave heating construct 100 includes a first pair of walls 102, 104 (e.g., side walls or side panels) (FIG. 1B) opposite one another, and a second pair of walls 106 (e.g., end walls or end panels) opposite one another. Each end wall 106 comprises an end wall assembly including a plurality of panels, as will be discussed in detail below. Each wall 102, 104, 106 has an upper edge (i.e., an uppermost edge) and a lower edge (i.e., lowermost edge) and a height H1 extending between the upper edge and lower edge of the respective wall. For example, as shown in FIG. 1B, side walls 102, 104 have respective upper edges 108, 110 and lower edges 112, 114.

As shown in FIG. 1A, a somewhat U-shaped food-supporting panel (or sling or cradle) 116 extends between the side walls 102, 104. The food-supporting panel may be joined to the first side wall 102 and the second side wall 104 along a respective first line of disruption and second line of disruption extending, for example, along a lengthwise dimension or length L1 of the construct 100. In the illustrated example, the first line of disruption 108 lies substantially along and generally comprises the upper edge 108 of the first side wall 102, and the second line of disruption 110 lies substantially along and generally comprises the upper edge 110 of the second side wall 104, such that the cradle 116 extends between the uppermost edges 108, 110 of the side walls 102, 104. However, it is contemplated that panel 116 may extend from or be joined to other parts of the side walls 102, 104.

Walls 102, 104, 106 and cradle 116 generally surround or define an interior space 118 for receiving one or more food items F supported on the cradle 116 (shown with dashed lines in FIG. 1B, in which the cradle 116 is shown schematically with heavier dashed lines). The food item may generally have at least one surface that is desirably browned and/or crisped, and in some embodiments, the food item has at least a top surface and a bottom surface that are desirably browned and/or crisped. The food item may also have side surfaces that are desirably browned and/or crisped. Further, in the case of a rounded or curved food item (or any other shape of food item), the entire surface may be desirably browned and/or crisped.

As best seen in FIG. 1B, the food-supporting panel 116 extends downwardly (and in some cases, downwardly and obliquely inwardly) from the first line of disruption 108 and second line of disruption 110 (in this example, from the upper or uppermost edges of walls 102, 104). A lowermost point of the cradle 116 is suspended above the lowermost edge 112, 114 of side walls 102, 104 (and end walls 106) a distance H2, such that a void V (shown with dashed lines in FIG. 1B) is defined beneath the cradle 116.

The somewhat U-shape of the cradle 116 is defined by at least one line of disruption, and in some cases, a plurality of lines of disruption, for example, fold lines 120 (e.g., score lines, cut-crease lines, etc.) (only some of which are labeled throughout), extending substantially along a lengthwise dimension L2 of the cradle 116 substantially between the end walls 106. In this example, the cradle 116 includes five fold lines 120. However, it will be appreciated that fewer or more lines may be used, and that the more lines used, the more the shape of the cradle 116 will approach a more smoothly rounded or curved U-shape. Such a shape may be particularly useful for supporting a more curved food item, for example, a corn dog, egg roll, stuffed breadstick, and so on. It will also be appreciated that in other embodiments, the lines of disruption may extend in a crosswise or transverse direction between side walls 102, 104. Further, the lengthwise dimension and crosswise dimension (i.e., widthwise dimension) may have any relative values, with either being greater than the other, such that the use of the term "length" is not intended to imply a major (i.e., greater) dimension of the construct.

If desired, the construct 100 may include one or microwave energy interactive materials 122 (shown schematically with stippling throughout the figures) that alter the effect of microwave energy on the food item in the construct. In the illustrated example, microwave energy interactive material 122 overlies and/or is joined to a side of the cradle 116 and the end walls 106 facing the interior space 118, and to a portion 102' of the first side wall 102, as will be discussed further below. However, in other embodiments, the microwave energy interactive material 122 may alternatively or additionally overlie and/or be joined to other portions of the construct 100.

In one example, the microwave energy interactive material 122 may comprise a susceptor for enhancing the heating, browning, and/or crisping of the food item. A susceptor is a thin layer of microwave energy interactive material, for example, aluminum, generally less than about 500 angstroms in thickness, for example, from about 60 to about 100 angstroms in thickness, and having an optical density of from about 0.15 to about 0.35, for example, about 0.17 to about 0.28. When exposed to microwave energy, the susceptor tends to absorb at least a portion of the microwave energy and convert it to thermal energy (i.e., heat) through resistive losses in the layer of microwave energy interactive material. The remaining microwave energy is either reflected by or transmitted through the susceptor. However, other microwave energy interactive elements may be used, as will be discussed further below.

Figure 1C:
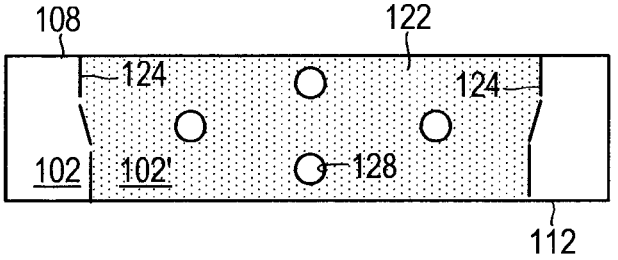
FIG. 1C is a schematic side elevation view of the microwave heating construct of FIG. 1A; taken along a line 1C-1C.

Turning now to FIG. 1C, if desired, the first side wall 102 may include at least one line of disruption that defines a movable portion 102' of the first side wall 102. In this example, the first side wall 102 includes a pair of lines of disruption 124, each of which comprises a plurality of spaced apart cuts (e.g., cut lines, slits, or cutouts). As stated above, the movable portion 102' of the first side wall 102 includes microwave energy interactive material 122, for example, a susceptor, as described above. It will be noted that in other examples, the movable portion 102' may be defined by a fewer number (e.g., one) or additional (e.g., more than two) lines of disruption (e.g., tear lines).

Figure 1D:
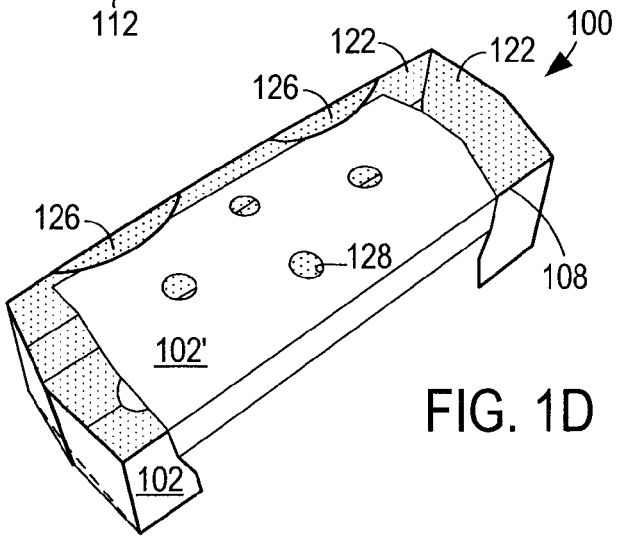
FIG. 1D is a schematic perspective view of the microwave heating construct of FIG. 1A, configured with the movable panel overlying the interior space.

The movable portion 102' of the first side wall 102 is generally operative for being partially separated from the remainder of the side panel 102 and pivoted towards the food item F until the exterior side of the movable portion 102' faces the interior space 118. More particularly, as shown in FIG. 1D, the movable portion 102' of the first side wall 102 may be separated (e.g., torn) along lines of disruption 124, folded towards the interior space 118 along fold line 108, and positioned over the food item within the interior space 118. In this configuration, the movable portion 102' of the first side wall 102 serves as a lid for overlying the food item so that the upper surface of the food item may be heated, browned, and/or crisped at the same time as the remaining portions of the food item seated on the cradle 116.

If desired, the construct 100 may be provided with one or more locking projections, tabs, or other features for maintaining or securing the movable portion 102' of the first side wall 102 in a locked position over the interior space 118 while the food item is being heated in a microwave oven. For example, in the illustrated embodiment, the construct 100 includes a pair of somewhat arcuate projections 126 that extend inwardly (i.e., towards the interior space 118) from the upper edge 110 of the second side wall 104. As shown in FIG. 1D, when the movable portion of the side panel is folded over the cradle 116 and the interior space 118 along fold line 108, the free edge (i.e., a portion of edge 112) of the movable portion 102' may be urged downwardly beneath the projections 126, so that the projections overlie and engage the movable portion 102' in a locked configuration. However, in other embodiments, the movable portion 102' or lid may simply be made to overlie the food item without such features. In still other embodiments, the movable portion 102' or lid may be omitted, for example, where top surface browning and/or crisping may not be needed, or where the user has been instructed to rotate or invert the food item during the heating cycle to ensure even browning and/or crisping.

The construct 100 may also include one or more venting apertures 128 that are operative for allowing moisture to be carried away from the food item to further enhance heating, browning, and/or crisping. In the illustrated example, the construct includes a plurality of apertures 128 extending through the cradle 116 (FIG. 1A) and a plurality of apertures 128 extending through the movable portion 102' of the first side panel 102 (FIGS. 1A, 1C, 1D). The apertures are illustrated as being generally circular in shape, but can have any other shape. In one example, the apertures may comprise slits or elongated cutouts. Further, the apertures of the cradle 116 are shown as having a generally larger diameter than the apertures of the movable portion 102' of the first side panel 102. However, any number, size, and shape of apertures may be used. The number, shape, spacing, and positioning of the apertures may vary depending on the food item to be heated and the desired degree of browning and crisping. Further, it will be understood that such apertures may be omitted or differently configured in other embodiments.

Figure 1E:
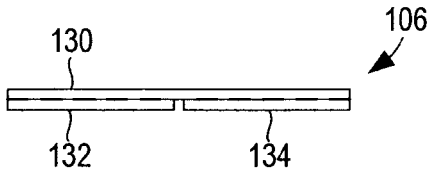
FIG. 1E is a schematic top plan view of an end panel assembly of the microwave heating construct of FIG. 1A, in isolation.
Figure 1F:
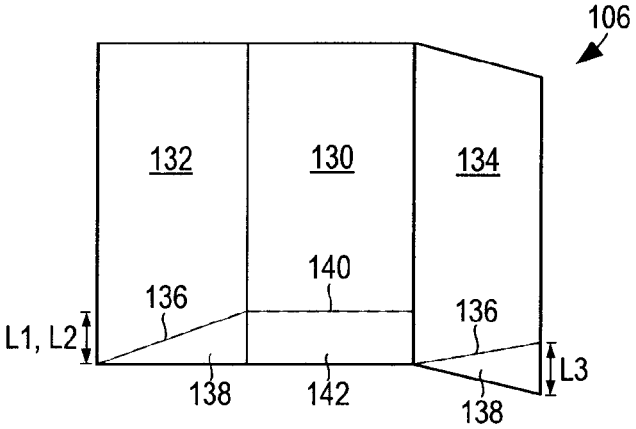
FIG. 1F is a schematic end elevation view of the construct of FIG. 1A, with the end panel assembly of FIG. 1E in a partially disassembled configuration.
Figure 1G:
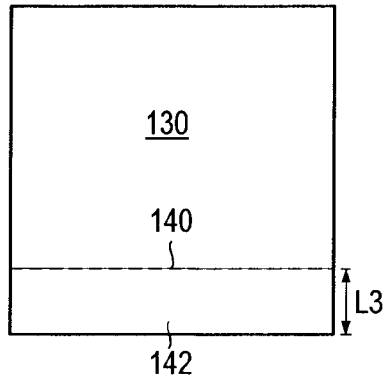
FIG. 1G is a schematic end elevation view of one panel of the end panel assembly of FIG. 1E, in isolation.
Figure 1H:
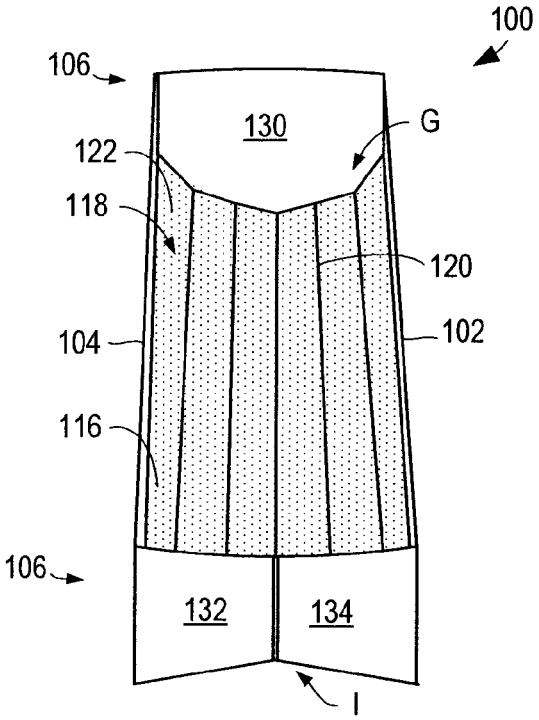
FIG. 1H is a schematic perspective view of the microwave heating construct of FIG. 1A, with the end support flaps in use.
Figure 1I:
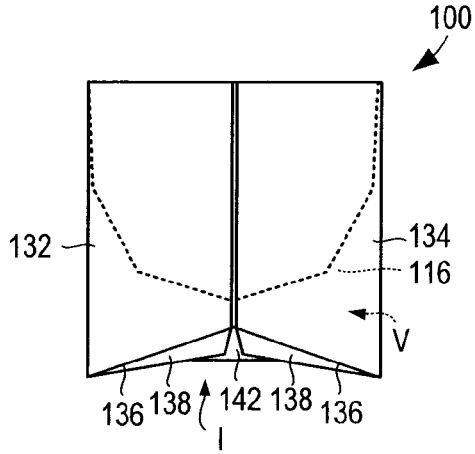
FIG. 1I is a schematic end elevation view of the microwave heating construct of FIG. 1H.

FIG. 1E schematically illustrates a top plan view of one end wall or end assembly 106 in isolation. Each end wall or end assembly 106 comprises a plurality of panels including an interior end panel 130 and a pair of exterior end panels 132, 134. The exterior end panels 132, 134 are in a substantially facing, contacting relationship with the interior end panel 130. Lines of disruption 136, for example, fold lines, in each exterior end panel 132, 134 define exterior end support flaps 138 (FIGS. 1F and 1G). Similarly, a line of disruption 140, for example, a fold line, extending substantially across each interior end panel 130 defines an interior support flap 142 (FIG. 1G, which shows the end panel 130 in isolation). As shown schematically in FIGS. 1H and 1I, if desired, the interior and exterior support flaps 138, 142 may be folded inwardly towards the void V (FIG. 1B) beneath the cradle 116, to assist with providing stability to the construct and supporting the cradle 116. The inwardly folded flaps 138, 142 define an indentation I along the lower portion of the end wall 106.

To use the construct 100 according to one exemplary method, a food item F may be positioned on the cradle 116 within the interior space 118. The food item may generally have lower, upper, and side surfaces, any of which may be desirably browned and/or crisped. The movable portion 102' of the first side wall 102 may be separated from the remainder of the first wall 102 by tearing along tear lines 124, and pivoted along fold line 108 so that the movable portion 102' overlies the food item on the cradle 116. The free edge (i.e., a portion of edge 112) of the movable portion 102' may be urged downwardly beneath the projections 126, so that the projections overlie and engage a peripheral margin of the movable portion 102' (proximate to edge 112).

Upon sufficient exposure to microwave energy in a microwave oven, the susceptor 122 of the cradle 116 and the lid 102' converts at least a portion of the impinging microwave energy into thermal energy, which then can be transferred to the food item to enhance heating, browning, and/or crisping of the various surfaces of the food item F, so that the entire food item can be heated, browned, and/or crisped at the same time. Notably, since the cradle 116 is generally U-shaped, the microwave energy interactive material 122 of the cradle 116 is more closely adjacent to more of the surface of the food item (e.g., the lower surface and the sides of the food item), as compared with a generally planar structure. Further, where the food item has a rounded shape and/or extends above the upper edges 108, 110 of the side walls, the movable portion 102' may be sufficiently flexible to round downwardly around (or otherwise conform to) the food, thereby bringing the microwave energy interactive material 122 of the lid 102' into even closer proximity with the upper surface of the food item. Thus, the microwave heating construct 100 may be suitable for heat, brown, and/or crisp a variety of rounded food items without requiring that that food item be inverted or repositioned during heating.

Additionally, by maintaining the food item F in an elevated position on the cradle 116, the air in the void V between the cradle 116 and the floor of the microwave oven may provide an insulating effect, thereby decreasing the amount of heat loss from the microwave energy interactive material of the susceptor 122 to the floor of the microwave oven. As a result, the heating of the food item and the browning and/or crisping of the bottom and sides of the food item may be enhanced further. Further, where one or more venting apertures 128 are provided, any water vapor and other gases may be diffuse away or be carried away from the food item F, thereby improving browning and/or crisping of the food item.

In some instances, the food item F may also include exudates that pass from the food item during heating. Such exudates may likewise pass through such apertures 128, where present. Additionally or alternatively, all or a portion of such exudates may pass through a gap G (FIG. 1H between the cradle 116 and the end walls 106 (specifically, end panel 130) and be collected on end support flaps 142 (when the support flaps 142 are folded beneath the ends of the cradle 116). Numerous other possibilities are contemplated.

When the food item is sufficiently heated, the food item F and construct 100 may be removed from the microwave oven. If desired, the notch or indentation I formed by the tucked in support flaps 138, 142 may be used to grasp the construct 100.

Figure 1J:
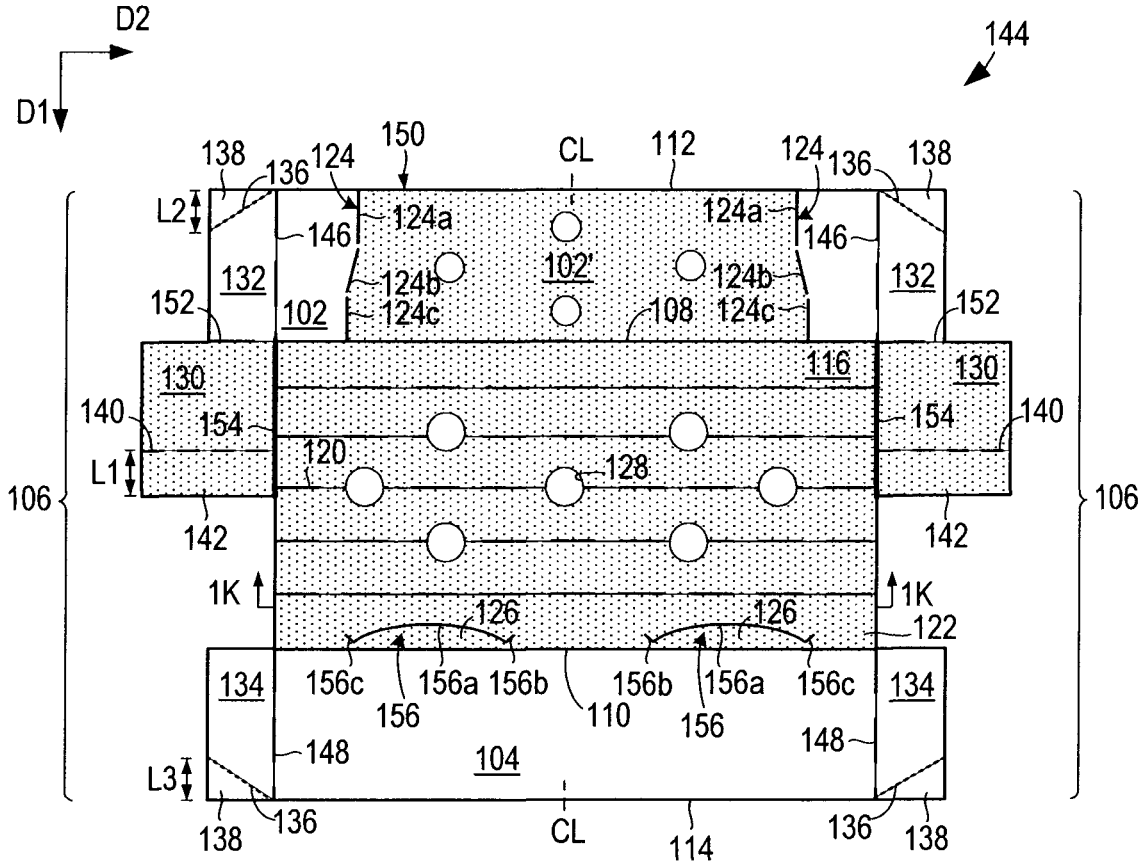
FIG. 1J is a schematic top plan view of one side of an exemplary blank for forming the microwave heating construct of FIGS. 1A-1I.

FIG. 1J schematically illustrates a top plan view of a first, interior side of an exemplary blank 144 for forming the microwave heating construct 100 of FIG. 1A. The blank 144 generally includes a plurality of panels joined along lines of disruption, for example, fold lines, fold lines, tear lines, score lines, or any other lines of weakening or disruption. The blank 144 and each of the various panels generally has a first dimension, for example, a length, extending in a first direction, for example, a longitudinal direction, D1, and a second dimension, for example, a width, extending in a second direction, for example, a transverse direction, D2. It will be understood that such designations are made only for convenience and do not necessarily refer to or limit the manner in which the blank is manufactured or erected into the package. The blank 144 may be symmetric or nearly symmetric along a longitudinal centerline CL. Therefore, certain elements in the drawing figures may have similar or identical reference numerals to reflect the whole or partial symmetry.

As shown in FIG. 1J, the blank 144 includes a first or main panel 116 that generally forms the sling 116 of the construct 100 formed from the blank 144. A plurality of transverse lines of disruption, for example, cut-crease lines, score lines, or fold lines 120, extend substantially across the main panel 116. In this example, panel 116 includes five fold lines 120; however, other numbers of fold lines can be used, as described above.

Side panels 102, 104 (i.e., a first side panel 102 and a second side panel 104) are joined to opposite longitudinal ends of the main panel 116 along respective transverse lines of disruption, for example, fold lines 108, 110. Pairs of end flaps 132, 134 are joined respectively to opposite transverse ends of side panels 102, 104 along respective lines of disruption, for example, longitudinal fold lines 146, 148. A line of disruption, for example, oblique fold line 136, extends across the corner of each end flap 132, 134. Each oblique fold line 136 may extend substantially from a first point substantially to a second point along the peripheral edge 150 of the blank 144. The first point may generally lie along (or may be proximate to) a longitudinal peripheral edge of the respective end flap 132, 134. The second point may generally be at (or proximate to) an intersection between the respective fold line 146, 148 and a transverse peripheral edge of the respective end flap 132, 134. Oblique fold lines 136 define corner portions 138 of panels 132, 134, which serve as exterior support flaps 138 of the erected construct 100 (FIG. 1A).

Still viewing FIG. 1J, the blank 144 includes a pair of end panels 130 joined to respective longitudinal ends of end flaps 132 along respective transverse lines of disruption, for example, fold lines 152. The end panels 130 are adjacent to, but separated from, the main panel 116 by respective cuts 154. Each end panel 130 includes a transverse line of disruption, for example, a fold line 140, extending substantially between a longitudinal peripheral edge of the respective end panel 130 and the respectively adjacent cut 154. Fold lines 140 define lower portions 142 of panels 130, which serve as interior support flaps 142 of the erected construct 100 (FIG. 1A).

A dimension L1 is measured from fold lines 140 to the transverse peripheral edge of panels 130 opposite fold lines 152. A dimension L2 is measured from oblique fold lines 136 along the longitudinal peripheral edge of panels 132 to the transverse peripheral edge of panels 132 opposite fold lines 152. A dimension L3 is measured from oblique fold lines 136 along the longitudinal peripheral edge of panels 134 to the transverse peripheral edge of panels 134 opposite fold lines 152. Fold lines 140 are generally positioned so that L1, L2, and L3 are approximately equal to one another. In this manner, corner panels 138 (i.e., exterior end flaps 138) and lower portions 142 (i.e., interior support flaps 142) may be folded inwardly together along respective fold lines 136, 140 to define an indentation I, as discussed above in connection with FIGS. 1F-1I.

A respective one of each of panels 130, 132, 134 (including panel portions 138, 142) collectively define each end wall assembly 106 of the erected construct 100 (FIG. 1A).

Still viewing FIG. 1J, side panel 102 includes a pair of lines of disruption 124, for example, tear lines (e.g., spaced apart cuts, slits, or cutouts), extending substantially from and between fold line 108 and peripheral edge portion 112 (it will be noted that peripheral edge 150 includes peripheral edge portions 112, 114). Each tear line 124 generally has a dogleg shape (or is generally "doglegged" in shape, such that tear line 124 resembles the shape of a dog's leg). A first portion 124*a* of tear line 124 extends substantially in the first direction from peripheral edge portion 112, a second portion 124*b* of tear line 124 extends obliquely and outwardly (towards adjacent panel 132) substantially from the first portion, and a third portion 124*c* of tear line 124 extends substantially from the second portion substantially to fold line 108. The space between fold line 108, peripheral edge portion 112, and tear lines 124 generally defines a movable portion 102' of panel 102.

If desired, the main panel 116 may include a pair of cuts 156 proximate to fold line 110. In the illustrated embodiment, each cut includes a generally arcuate central portion 156*a* and a pair of oblique portions 156*b*, 156*c* that extend from ends of the arcuate portion 156*a*, however, oblique cut portions 156*b*, 156*c* may be omitted if desired. The arcuate portion 156*a* of each cut 156 extends generally inwardly towards the main panel 116 away from fold line 110, with the ends of the arcuate portion 156*a* being proximate to (or disposed substantially along) fold line 110. The oblique portions 156*b*, 156*c* of the cuts extend outwardly from one another away from fold line 110. However, other numerous other shapes and configurations of cuts are contemplated. The end of each arcuate portion 156*a* adjacent to respective oblique cut 156*c* is generally aligned in the second direction D2 with the respective tear line portion 124*c* of tear line 124 of panel 102. The area between cuts 156 and fold line 110 generally defines projections 126 that are struck from panel 116 when the blank is erected into the construct 100 (FIG. 1A).

The blank 144 may also include a plurality of apertures 128. In this example, the main panel 116 includes seven substantially circular apertures and side panel 102 includes four substantially circular apertures. As illustrated, the diameter of the apertures of the main panel 116 is greater than the diameter of the apertures of panel 102. However, as stated above, countless other configurations of apertures may be used.

If desired, a microwave energy interactive material 122 may overlie and/or be joined to one or more panels or portions of the blank 144. In this example, a layer of microwave energy interactive material, for example, susceptor 122, overlies substantially all of the main panel 116 and panels 130. Further, the microwave energy interactive material overlies the movable portion 102' of panel 102 extending between fold line 108, peripheral edge portion 112, and lines of disruption 124. However, other configurations are contemplated.

Figure 1K:
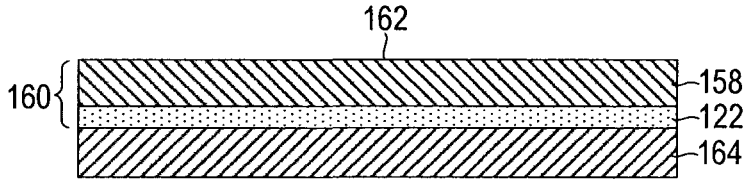
FIG. 1K is a schematic cross-sectional view of a portion of the blank of FIG. 1J, taken along a line 1K-1K.

As shown in FIG. 1K, the layer of microwave energy interactive material (i.e., susceptor) 122 may be supported on a polymer film 158 to define a susceptor film 160. The outermost surface (i.e., the exposed surface) 162 of the polymer film 158 may serve as a food-contacting surface of the construct 100 erected from the blank 144 (FIG. 1A). The susceptor film 160 is typically joined (e.g., laminated) to a support layer 164, for example, paper or paperboard, using an adhesive or otherwise (not shown), to impart dimensional stability to the susceptor film 160 and to protect the layer of microwave energy interactive material 122 from being damaged.

Figure 1L:
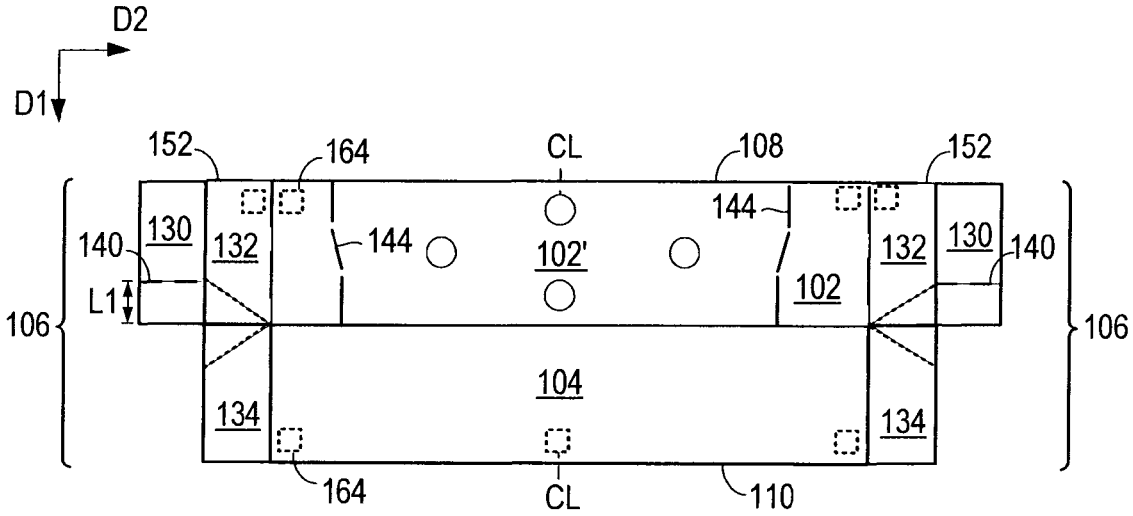
FIG. 1L is a schematic top plan view of the blank of FIG. 1J, partially erected into the microwave heating construct, in a flattened configuration.
Figure 1M:
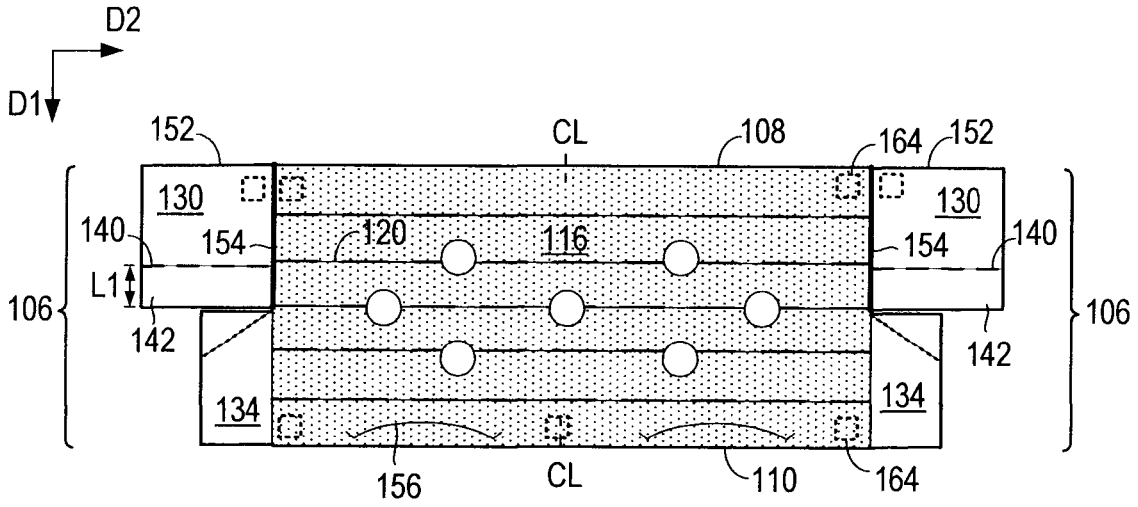
FIG. 1M is an alternate view of the partially erected construct of FIG. 1L.

To form the blank 144 into the construct 100 according to one acceptable method, side panel 104 may be folded downwardly and joined via glue (or otherwise) to the portion of the main panel 116 that is proximate to fold line 110. Similarly, panels 102, 132 may be folded downwardly and joined respectively via glue (or otherwise) to the main panel 116 and end panels 130 proximate to respective fold lines 108, 152 to form a partially erected construct having a substantially flattened configuration, as shown in alternate views FIGS. 1L and 1M (in which exemplary glue areas 164 are shown with dashed lines). Next, edges 108, 110 (i.e., fold lines 108, 110) may be brought towards one another by urging the partially erected construct against a mandrel (or using any other suitable technique). In doing so, the main panel 116 may flex or fold along fold lines 120 as needed to bring end panels 130 and end flaps 132, 134 into an upright configuration. Adjoined end panels 130 and end flaps 132 may be folded inwardly along fold lines 146 towards panel 116. Next, end flaps 134 may be folded inwardly along fold lines 148 and brought into a substantially facing, contacting relationship with end panels 130. The end flaps 134 may be joined to the end panels 130 in any suitable manner, for example, using an adhesive to form the erected construct 100. The construct 100 may be used as described above.

Numerous microwave heating constructs are encompassed by the disclosure. Any of such structures or constructs may be formed from various materials, provided that the materials are substantially resistant to softening, scorching, combusting, or degrading at typical microwave oven heating temperatures, for example, at from about 250° F. to about 425° F. The materials may include microwave energy interactive materials, for example, those used to form susceptors (e.g., susceptor 122) and other microwave energy interactive elements, and microwave energy transparent or inactive materials, for example, those used to form the remainder of the construct.

The microwave energy interactive material may be an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

As stated above, the microwave energy interactive material (e.g., microwave energy interactive material 122) may be supported on a polymer film (e.g., polymer film 158). The thickness of the film typically may be from about 35 gauge to about 10 mil, for example, from about 40 to about 80 gauge, for example, from about 45 to about 50 gauge, for example, about 48 gauge. Examples of polymer films that may be suitable include, but are not limited to, polyolefins, polyesters, polyamides, polyimides, polysulfones, polyether ketones, cellophanes, or any combination thereof. In one specific example, the polymer film may comprise polyethylene terephthalate (PET). Examples of PET films that may be suitable include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.). The polymer film may be selected to impart various properties to the microwave interactive web, for example, printability, heat resistance, or any other property. As one particular example, the polymer film may be selected to provide a water barrier, oxygen barrier, or any combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

If desired, the polymer film may undergo one or more treatments to modify the surface prior to depositing the microwave energy interactive material onto the polymer film. By way of example, and not limitation, the polymer film may undergo a plasma treatment to modify the roughness of the surface of the polymer film. While not wishing to be bound by theory, it is believed that such surface treatments may provide a more uniform surface for receiving the microwave energy interactive material, which in turn, may increase the heat flux and maximum temperature of the resulting susceptor structure. Such treatments are discussed in U.S. Patent Application Publication No. 2010/0213192 A1, published Aug. 26, 2010, which is incorporated by reference herein in its entirety.

Other non-conducting substrate materials such as paper and paper laminates, metal oxides, silicates, cellulosics, or any combination thereof, also may be used.

If desired, the susceptor may be used in conjunction with other microwave energy interactive elements and/or structures. Structures including multiple susceptor layers are also contemplated.

By way of example, the susceptor film may be used with a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Examples of microwave energy distributing elements are described in U.S. Pat. Nos. 6,204,492, 6,433,322, 6,552,315, and 6,677,563.

In still another example, the susceptor film and/or structure may be used with or may be used to form a microwave energy interactive insulating material. Examples of such materials are provided in U.S. Pat. Nos. 7,019,271, 7,351,942, and U.S. Patent Application Publication No. 2008/0078759 A1, published Apr. 3, 2008.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas to effect dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas must be balanced to attain the desired overall heating characteristics for the particular food item.

In some embodiments, one or more portions of the susceptor may be designed to be microwave energy inactive to ensure that the microwave energy is focused efficiently on the areas to be heated, browned, and/or crisped, rather than being lost to portions of the food item not intended to be browned and/or crisped or to the heating environment. Additionally or alternatively, it may be beneficial to create one or more discontinuities or inactive regions to prevent overheating or charring of the food item and/or the construct including the susceptor. By way of example, the susceptor may incorporate one or more "fuse" elements that limit the propagation of cracks in the susceptor structure, and thereby control overheating, in areas of the susceptor structure where heat transfer to the food is low and the susceptor might tend to become too hot. The size and shape of the fuses may be varied as needed. Examples of susceptors including such fuses are provided, for example, in U.S. Pat. Nos. 5,412,187, 5,530,231, U.S. Patent Application Publication No. US 2008/0035634A1, published Feb. 14, 2008, and PCT Application Publication No. WO 2007/127371, published Nov. 8, 2007.

In the case of a susceptor, any of such discontinuities or apertures may comprise a physical aperture or void in one or more layers or materials used to form the structure or construct, or may be a non-physical "aperture". A non-physical aperture is a microwave energy transparent area that allows microwave energy to pass through the structure without an actual void or hole cut through the structure. Such areas may be formed by simply not applying microwave energy interactive material to the particular area, by removing microwave energy interactive material from the particular area, or by mechanically deactivating the particular area (thereby rendering the area electrically discontinuous). Alternatively, the areas may be formed by chemically deactivating the microwave energy interactive material in the particular area, thereby transforming the microwave energy interactive material in the area into a substance that is transparent to microwave energy (i.e., microwave energy inactive). While both physical and non-physical apertures allow the food item to be heated directly by the microwave energy, a physical aperture also provides a venting function to allow steam or other vapors or liquid released from the food item to be carried away from the food item.

As stated above, the susceptor film (e.g., susceptor film 160) (and/or other microwave energy interactive elements) may be joined to a paper or paperboard support (e.g., support 164) that may impart dimensional stability to the structure. The paper may have a basis weight of from about 15 to about 60 lb/ream (lb/3000 sq. ft.), for example, from about 20 to about 40 lb/ream, for example, about 25 lb/ream. The paperboard may have a basis weight of from about 60 to about 330 lb/ream, for example, from about 80 to about 140 lb/ream. The paperboard generally may have a thickness of from about 6 to about 30 mils, for example, from about 12 to about 28 mils. In one particular example, the paperboard has a thickness of about 14 mils. Any suitable paperboard may be used, for example, a solid bleached sulfate board, for example, Fortress® board, commercially available from International Paper Company, Memphis, Tenn., or solid unbleached sulfate board, such as SUS® board, commercially available from Graphic Packaging International, Marietta, Ga.

While the present invention is described herein in detail in relation to specific aspects and embodiments, it is to be understood that this detailed description is only illustrative and exemplary of the present invention and is made merely for purposes of providing a full and enabling disclosure of the present invention and to set forth the best mode of practicing the invention known to the inventors at the time the invention was made. The detailed description set forth herein is illustrative only and is not intended, nor is to be construed, to limit the present invention or otherwise to exclude any such other embodiments, adaptations, variations, modifications, and equivalent arrangements of the present invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other. Further, various elements discussed with reference to the various embodiments may be interchanged to create entirely new embodiments coming within the scope of the present invention.

What is claimed is:

1. A microwave heating construct, comprising:

a first side wall and a second side wall opposite one another; and a food-supporting panel extending between the first side wall and the second side wall, the first side wall including at least one line of disruption that defines a movable portion of the first side wall, wherein the movable portion of the first side wall is for being separated along the at least one line of disruption and positioned over the food-supporting panel, and the food-supporting panel and the movable portion of the first side wall each include microwave energy interactive material; and the food-supporting panel is joined to the first side wall and the second side wall along a respective first line of disruption and second line of disruption extending in a first direction, the food-supporting panel extends downwardly from the first line of disruption and second line of disruption.

2. The microwave heating construct of claim 1, further comprising a projection extending inwardly from an upper edge of the second side wall, the projection being for engaging the movable portion of the first side wall when the movable portion of the first panel is positioned over the food-supporting panel.

3. The microwave heating construct of claim 2, wherein the projection is a first projection of a plurality of projections extending inwardly from the upper edge of the second side wall.

4. The microwave heating construct of claim 1, wherein the first side wall and the second side wall each have an upper edge and a lower edge, the first line of disruption lies along the upper edge of the first side wall, and the second line of disruption lies along the upper edge of the second side wall.

5. The microwave heating construct of claim 4, wherein the food-supporting panel includes a lowermost point that is at a higher elevation than the lower edge of the first side wall and the second side wall.

6. The microwave heating construct of claim 1, further comprising a void beneath the food-supporting panel.

7. The microwave heating construct of claim 1, wherein the food-supporting panel includes a line of disruption extending along a length of the food-supporting panel.

8. The microwave heating construct of claim 1, further comprising a pair of end walls joined to respective ends of the first side wall and second side wall, the end walls comprising microwave energy interactive material.

9. A method of preparing a food item in a microwave oven using the microwave heating construct of claim 1, the food item having an upper surface and a lower surface that are each desirably heated, comprising:

with the food item seated on the food supporting panel, positioning the movable portion of the first side wall over the food item; and exposing the food item in the microwave heating construct to microwave energy, so that the microwave energy interactive material of the food-supporting panel heats the lower surface of the food item, and the microwave energy interactive material of the movable portion of the first side wall heats the upper surface of the food item.

10. The method of claim 9, wherein reconfiguring the microwave heating construct further comprises separating the movable portion along the at least one line of disruption before positioning the movable portion of the first side wall over the food item.

11. The method of claim 9, wherein the microwave heating construct further comprises a projection extending from the second side wall, and the method further comprises engaging the movable portion of the first side wall with the projection.

12. The method of claim 9, wherein positioning the movable portion of the first side wall over the interior space comprises folding the movable portion of the first side wall along the first line of disruption joining the food-supporting panel to the first side wall.

13. A microwave heating construct, comprising:

a first side wall and a second side wall opposite one another; and a food-supporting panel extending between the first side wall and the second side wall, the first side wall including at least one line of disruption that defines a movable portion of the first side wall, wherein the movable portion of the first side wall is for being separated along the at least one line of disruption and positioned over the food-supporting panel, and the food-supporting panel and the movable portion of the first side wall each include microwave energy interactive material; and wherein the food-supporting panel includes a plurality of lines of disruption extending in a lengthwise direction along the food-supporting panel, so that the food-supporting panel has a generally U-shape.

14. A blank for a microwave heating construct, the blank comprising:

a plurality of adjoined panels, each panel having a first dimension extending in a first direction and a second dimension extending in a second direction, the first direction being substantially perpendicular to the second direction, the plurality of adjoined panels including a first panel including a plurality of lines of disruption extending in the second direction substantially across the first panel, and a second panel and a third panel joined to opposite edges of the first panel along respective first and second fold lines extending in the second direction, wherein the first panel includes at least one line of disruption extending substantially in the first direction substantially from the first fold line to a peripheral edge of the second panel extending in the second direction, the at least one line of disruption defining a movable portion of the second panel, wherein the first panel and the movable portion of the second panel each include microwave energy interactive material, and the first panel includes an arcuate cut proximate to the second fold line, and the arcuate cut extends inwardly substantially from the second fold line.

15. The blank of claim 14, wherein the at least one line of disruption extending substantially in the first direction substantially from the first fold line to the peripheral edge of the second panel comprises a pair of tear lines extending substantially in the first direction substantially from the first fold line to the peripheral edge of the second panel.

16. The blank of claim 14, wherein the arcuate cut is a first arcuate cut of a pair of arcuate cuts proximate to the second fold line, wherein the arcuate cuts each have a pair of endpoints disposed substantially along the second fold line.

* * * * *